US007044311B2

(12) United States Patent
Flores Flores

(10) Patent No.: US 7,044,311 B2
(45) Date of Patent: May 16, 2006

(54) CASK SUPPORT

(75) Inventor: Sebastian Flores Flores, Lacuna (ES)

(73) Assignee: Sagarte, S.A., Navarra (ES)

( * ) Notice: Subject to any disclaimer, the term of this patent is extended or adjusted under 35 U.S.C. 154(b) by 156 days.

(21) Appl. No.: 10/819,497

(22) Filed: Apr. 7, 2004

(65) Prior Publication Data

US 2005/0103731 A1 May 19, 2005

(30) Foreign Application Priority Data

Nov. 13, 2003 (ES) ..... 200302621 U

(51) Int. Cl.
*A47G 29/00* (2006.01)

(52) U.S. Cl. ..... 211/85.22; 211/151; 211/194; 410/49

(58) Field of Classification Search ..... 211/85.22, 211/151, 74, 59.4, 194, 71.01, 189, 85.21, 211/85.18, 191, 195, 13.1, 162; 410/47, 410/48, 49, 50; 206/504, 509, 511
See application file for complete search history.

(56) References Cited

U.S. PATENT DOCUMENTS 1,739,403 A * 12/1929 Lundberg ..... 211/85.22
4,431,107 A * 2/1984 Bergstrom et al. ..... 211/59.4
6,170,686 B1 1/2001 Flores
6,360,903 B1 3/2002 Flores
6,523,706 B1 2/2003 Flores
6,536,612 B1 3/2003 Flores
6,637,607 B1 * 10/2003 Tombu ..... 211/85.22

FOREIGN PATENT DOCUMENTS

| | | |
|---|---|---|
| EP | 1036525 B1 | 9/2000 |
| EP | 1 057 735 | 4/2003 |
| EP | 1 066 772 | 4/2003 |
| ES | 1 040 068 | 1/1999 |

* cited by examiner

*Primary Examiner*—Richard E. Chilcot, Jr.
*Assistant Examiner*—Lindsay Maguire
(74) *Attorney, Agent, or Firm*—Adams Evans P.A.

(57) ABSTRACT

A cask support allows housing two casks (9) therein (1), such that the casks (9) will be arranged in a staggered manner when multiple supports are stacked together. Each support (1) includes two bedplates (2) with a seating for housing a cask (9). A carriage (10) formed by a rectangular platform is mounted to the framework of the support (1) with two brackets (15) with wheels (17) fixed to the carriage (10) which can move along each bedplate (2), and two other brackets (16) with wheels (19) fixed to the support and on which the platform of the carriage (10) slides. The carriage (10) has freedom of movement parallel to the bedplate (2). Each cask (9) rests on four rotating wheels (14) which are disposed on the vertices of the framework of the carriage (10). The cask support is especially applicable in large wine aging cellars.

4 Claims, 3 Drawing Sheets

CASK SUPPORT

This application claims priority to Spanish Utility Model No. U200302621, Filed Nov. 13, 2003.

OBJECT OF THE INVENTION

The present invention consists of a cask support, especially applicable in large cellars, of those allowing the casks to be accumulated without having to support the weight of those arranged on top of each one of them, given that it is a modular support which is stackable on other identical supports, forming a staggered stacking.

Each cask housed on this support is accommodated on an extractable carriage which has, furthermore, four freely rotatable wheels on which the side surface of the cask rests, allowing the rotation thereof with respect to its axial axis.

BACKGROUND OF THE INVENTION

In large wine ageing cellars, the casks are piled or stacked in resting position, i.e. with their bases placed according to vertical planes, such that the casks of the lower level rest between pairs of beams parallelly arranged on the ground and suitably wedged in order to prevent their movement.

The next levels of casks are obtained by means of the support thereof, one between another, remaining arranged in a staggered manner, always using wedges, and being stacked up to wherever necessary.

This system of stacking has various drawbacks, such as the difficult accessibility and handling of the casks, the deformation of the casks in the lower levels and the lack of safety in the stability of the casks, given that in the event of a wedge having a fault, a sliding and collapse may occur with the consequent danger for the cellar operators.

In order to solve the aforementioned problems, Spanish Utility Model with publication number ES1040068U, of the same applicant, claims a cask support constituted of a modular structure based on stringers and crossbeams of rectangular configuration, on the corners of which tubular parts have been vertically arranged in order to removably receive the attachment of corresponding vertical columns, whilst these tubular parts rely on hollow conical support legs on their lower end in order to receive, in the stacking with another support, the upper end of the vertical columns of the lower support, determining the modularity of the latter; a pair of longitudinal sections having been provided, forming part of the structure itself, preferably arranged corresponding with the upper edge of the stringers of the structure, in the profiles of which concavities are formed for the stable support of the casks. Furthermore, the structure supports two casks collaterally arranged with one another in a stable manner.

Likewise, the applicant is also the holder of the European Patents with publication numbers EP1057735B1 and EP1066772B1, wherein, with modifications of Utility Model ES1040068U, the cask supports can be assembled together with a considerable lateral displacement, forming a staggered arrangement which provides advantages in terms of facilitating the accessibility and mobility of the casks and a shorter height of the vertical columns or posts.

Finally, the applicant is also the holder of the European Patent with publication number EP1036525B1, claiming a cask support with a base structure, of a rectangular outline with seatings for a pair of laterally adjacent casks, having four wheels with rotational freedom arranged on the end of respective arms suitably integral with the base structure, such that the wheels stabilise and allow the rotation of the casks on their own axis with little effort. In this way, access to the entire surface of the deposited casks and the rotation thereof is facilitated even more than in the European Patents EP1057735B1 and EP1066772B1.

DESCRIPTION OF THE INVENTION

The present invention refers to a cask support, especially applicable in large cellars, incorporating added advantages to the cask supports existing on the market, by allowing a significant improvement in the access and handling of the cask.

The cask support object of the present invention allows the accumulation of casks without these having to support the weight of those arranged on top of each one of them, given that it is a modular support, conceived mainly to support a pair of collaterally arranged casks, being only the supports, in their staggered stacking, those which support the weight situated above them.

The support consists of two rectangular bedplates to which a prismatic-rectangular angle block is coupled on the lower part of each one of their ends, and a reinforcement support welded to a framework on the upper part of each one of their ends. The framework is made up of two upwardly divergent lower tubes to which the reinforcement supports are welded, which start from the end of each one of the bedplates; the framework also has two upper or end tubes perpendicular to the support plane of the angle blocks, and which have projections on their upper end, whereas their lower ends are welded to the upper ends of the lower divergent tubes.

Each support will be made up of four frameworks such as those described, such that two of these frameworks are in a coplanar arrangement and are fixed to one another through the adjacent upper or end tubes, the other two frameworks being placed on a plane parallel to the aforementioned one, and connected with the first frameworks by means of the bedplate and crossbeams of a considerably shorter length than the axial height of the casks, whereas the slope and length of the divergent tubes of the different frameworks are suitable in order for the spacing between the upper tubes to be suitable to allow the passage of the casks towards their seating area.

A seating is arranged on each bedplate of the support for the housing of a cask, which seating consists of a carriage which can be displaced parallelly to the bedplate and perpendicularly to the vertical plane defined by the frameworks of the support, allowing the casks to be entirely extracted from their support. Furthermore, the carriage has a freely rotatable wheel on each one of its four vertexes, such that the side surface of the cask rests on these wheels, allowing the rotation of the cask with respect to its axial axis with minimum effort.

In this way, operations such as the cleaning of the casks, sampling, carrying out the decanting of the content thereof or the "batonaus" process, are facilitated even more.

BRIEF DESCRIPTION OF THE DRAWINGS

The following figures are included for the purpose of helping to understand the invention:

FIG. 4 shows a front view of an angle block according to the A-B section line in FIG. 3.

PREFERRED EMBODIMENT OF THE INVENTION

A preferred embodiment of the invention, which is to be understood in a broad and non-limiting sense, is detailed below.

Figure 1:
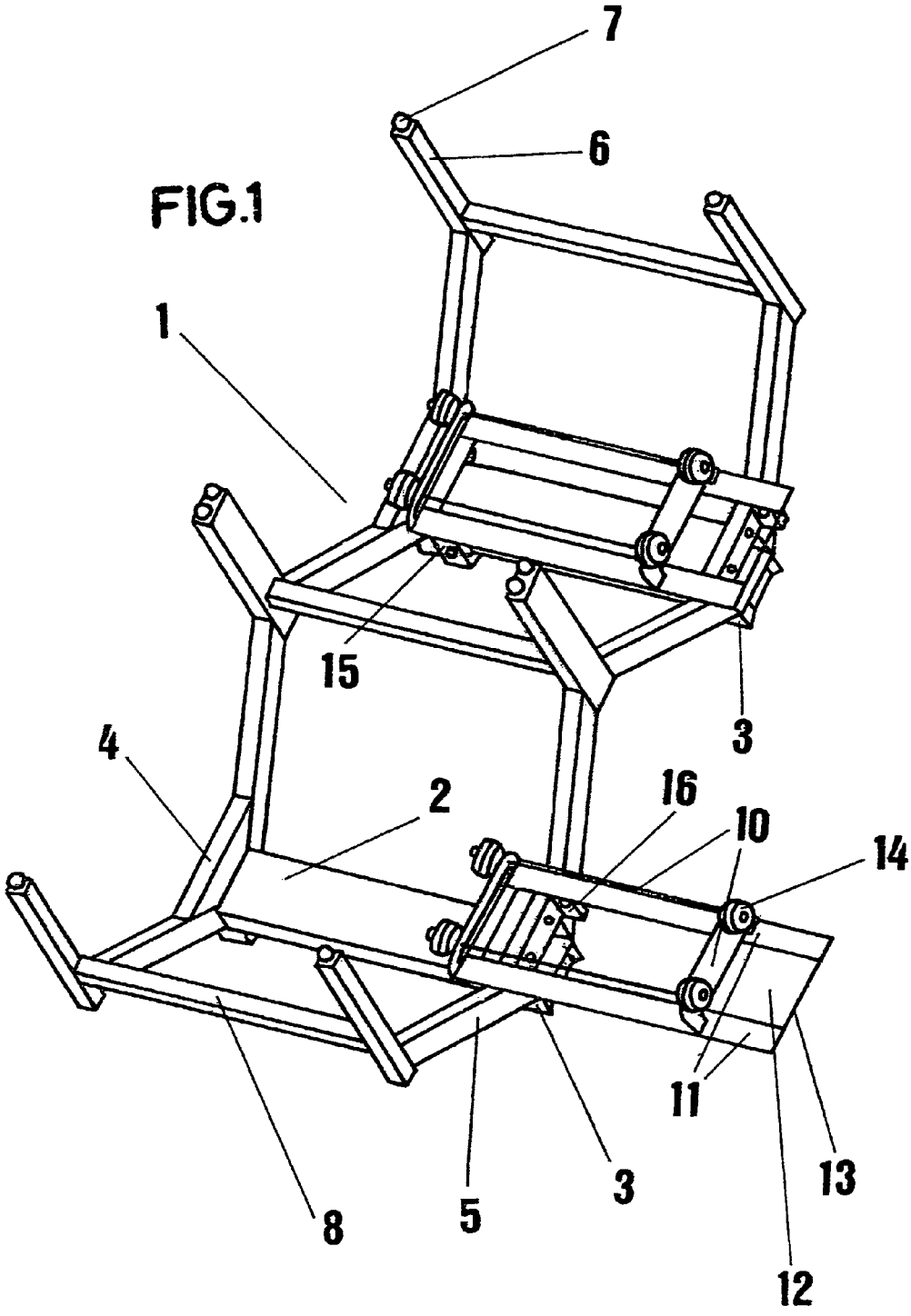
FIG. 1 shows a perspective view of the cask support.

FIG. 1 shows a cask support (1), especially applicable in large cellars, and which allows the accumulation of the casks without these having to support the weight of those placed on top of each one of them.

The support (1) consists of two rectangular bedplates (2) formed by a hollow tube of rectangular section, which incorporate a prismatic-rectangular angle block (3) on the lower part of each one of their ends. A reinforcement support (4) is fixed on the upper part of each end of each bedplate (2).

Part of the structure of the support (1) is a framework made up of two upwardly divergent lower tubes (5) to which the reinforcement supports (4) are welded. These two lower tubes (5) start from each end of each one of the two bedplates (2). Furthermore, the framework consists of two upper or end tubes (6) perpendicular to the support plane of the angle blocks (3), and which have rounded projections (7) on their upper end, whereas the lower end of these tubes (6) is welded to the upper end of the lower divergent tubes (5).

Each support (1) will be made up of four frameworks such as the one described, such that two of these frameworks have a coplanar arrangement and are fixed to one another through the adjacent upper tubes (6), the other two frameworks being situated on a vertical plane parallel to the previous one and connected with the first frameworks by means of the bedplate (2) and crossbeams (8) of a considerably shorter length than the axial height of the casks, whilst the slope and length of the divergent tubes (5) are suitable in order for the spacing between the upper tubes (6) to be suitable to allow the passage of the casks towards their seating area.

Figure 2:
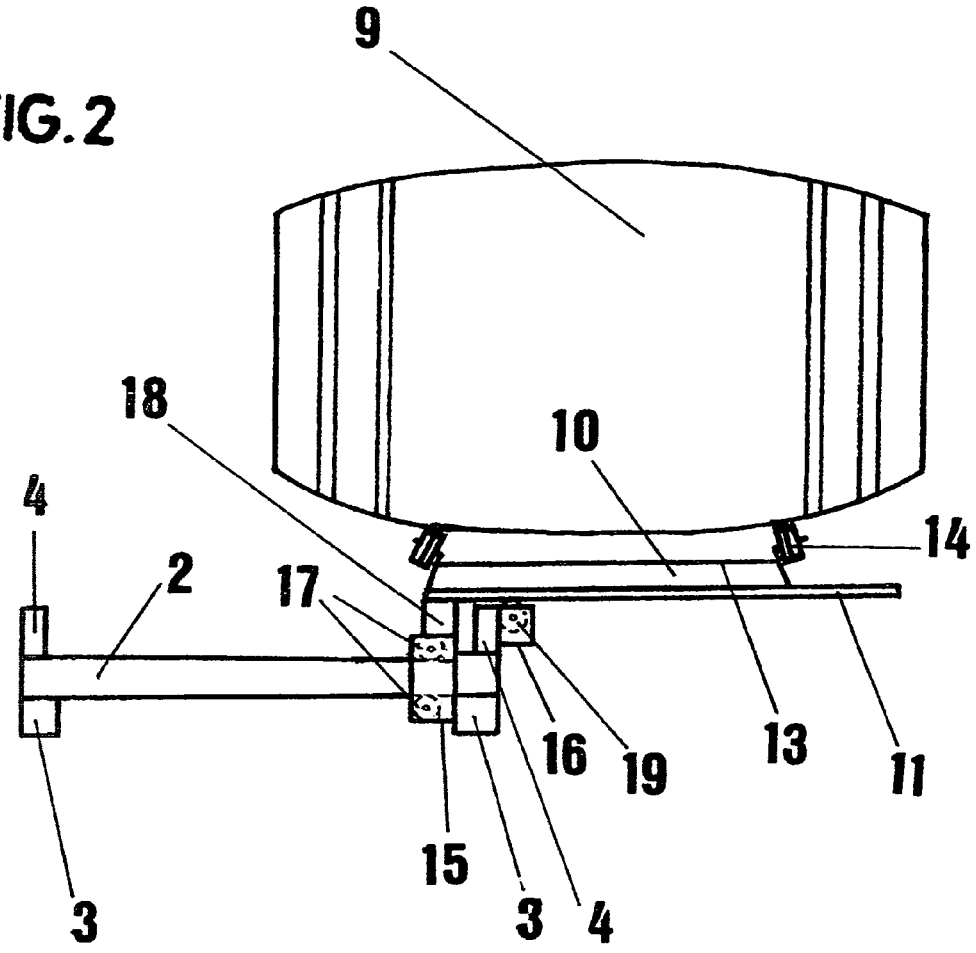
FIG. 2 shows a side view of the bedplate and the carriage displaced with a cask.

As can be observed in FIGS. 1 and 2, a seating is arranged on each one of the two bedplates (2) of the support (1) for the housing of a cask (9), consisting of a carriage (10) which can be displaced parallelly to the bedplate (2) and perpendicularly to the vertical plane defined by the frameworks of the support, allowing the casks (9) to be entirely extracted from their support (1).

The carriage (10) is constituted of a flat rectangular platform, the major sides of which are defined by two elongated metallic plates (11), with one end projecting from the platform beyond the front vertical plane defined by the lower tubes (5), and which carries out the functions of a handle (12) for the extraction of the carriage (10). The two minor sides of the platform join the ends of the plates (11) and are formed by two metallic rods (13).

A framework of a rectangular structure is arranged on the upper surface of the platform of the carriage (10), the major sides of which framework are shorter than the plates (11).

A freely rotatable wheel (14) rotatable on its own axis is assembled on each one of the four vertices of the framework. The major sides of this framework can be constituted of an elongated shaft shared by two wheels. The side surface of the cask (9) rests on these wheels, allowing the rotation thereof on their own axial axis with minimum effort. The wheels will preferably be manufactured with a material which does not damage the surface of the casks.

The extraction movement of the carriage (10), with a displacement parallel to the bedplate (2), is obtained by means of four brackets (15, 16) or, alternatively, two double brackets.

The first two brackets (15) (only one of them can be seen in FIGS. 1 and 2) are displaced on the bedplate (2) between two reinforcement supports (4), and each one of them has two overlapping shafts with a vertical wheel (17) on each one of them. Each one of these brackets (15) is fixed to the lower surface of the vertices of the minor side of the platform of the carriage (10) which does not constitute the handle (12) by means of an arm (18), such that the wheel of the upper shaft rests and rolls on the upper surface of the bedplate (2) and the wheel of the lower shaft makes contact with and rolls on the lower surface of the bedplate (2).

Alternatively, these two brackets can be replaced by a single bracket having two elongated shafts inside it, an upper one and a lower one, with a vertical wheel on each end of the two shafts, carrying out the same functions as those previously described.

Two other brackets (16) with a single vertical wheel (19) are fixed on the outer part of the reinforcement support (4) on the side of the handle (12), such that the lower surface of each one of the two plates (11) of the platform of the carriage (10) rests and slides on one of these wheels. Alternatively, this mortise can be replaced by a single mortise having an elongated shaft inside it with a vertical wheel on each end, carrying out the same functions as those previously described.

Since this support (1) allows the rotation of the cask on its own axis and the extraction thereof on its own seating, the logical operations of a cellar such as the cleaning of the casks, sampling, carrying out the decanting of the content thereof or the "batonaus" process, are significantly facilitated.

Figure 3:
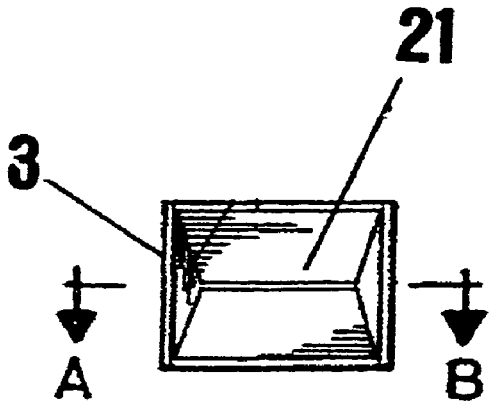
FIG. 3 shows a lower plan view of an angle block.
Figure 3:
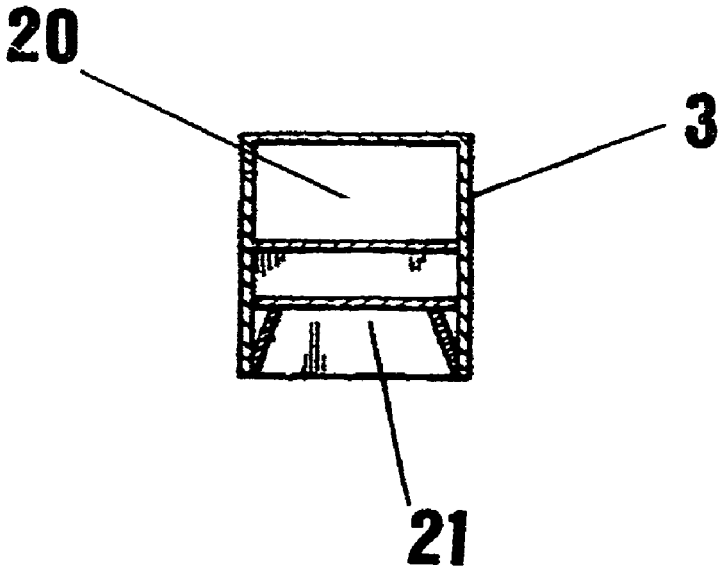

FIGS. 3 and 4 show one of the four angle blocks (3) of each support (1), preferably prismatic-rectangular, which have a wide hole (20) on their upper level allowing the passage of the arms of a forklift truck or the like, and a receptacle (21) on the lower level, which is open towards its lower side and upwardly convergent, preferably of a pyramidal configuration, said receptacle being intended for receiving inside it a free end with rounded projections (7) of the upper or end tubes (6) in the stacking among supports (1).

The invention claimed is:

1. A support (1)for casks (9) including a structure allowing the mounting of a pair of casks on the same support, said support being adapted to be stacked on another one of said supports in a staggered manner, said support comprising two bedplates (2), each bedplate including a seating for the housing of a cask (9), said seating formed by a carriage (10) with freedom of movement parallel to the bedplate (2) and perpendicular to a vertical plane defined by a framework of the support (1); characterized in that the carriage (10) is formed by a flat rectangular platform, said platform comprising:

a pair of spaced-apart elongated metallic plates (11) each having an inner end and an outer end, said outer ends of said plates projecting from the platform beyond the vertical plane defined by the framework of the support (1);

first and second metallic rods (13) joining the inner and outer ends of the metallic plates (11), respectively;

an arm (15) carrying a first bracket (15) disposed on the lower surface of each plate at the inner end thereof;

spaced apart upper and lower shafts extending laterally between said first brackets (15), each shaft carrying at least one vertical wheel (17), such that the vertical wheel (17) of the upper shaft rests on an upper surface of the bedplate (2) and the vertical wheel (17) of the lower shaft makes contact with a lower surface of the bedplate (2); and two spaced-apart second brackets (16) each including a vertical wheel (19) fixed on the support (1) on a side thereof facing the outer end of the carriage (10), such that a lower surface of each one of the two plates (11) of the platform of the carriage (10) rests on one of said vertical wheels (19) of said second brackets (16).

2. A support (1) for casks (9) according to claim 1, further comprising:

a rectangular framework disposed on an upper surface of the platform of the carriage (10), the major sides of which framework are shorter than the plates (11); and a wheel (14) rotatable about its axis disposed at each one of the four corners of the framework.

3. A support 1 for casks (9) including a structure allowing the mounting of a pair of casks on the same support, said support being adapted to be stacked on another one of said supports in a staggered manner, said support comprising two bedplates (2), each bedplate including a seating for the housing of a cask (9), said seating formed by a carriage (10) with freedom of movement parallel to the bedplate (2) and perpendicular to a vertical plane defined by a framework of the support (1), wherein said support includes:

a plurality of frameworks, each framework having:

two upwardly divergent lower tubes (5) having upper and lower ends, the lower ends of said lower tubes being attached to said bedplates (2);

a reinforcement support (4) welded to said lower tubes; and two vertically-extending upper tubes (6) having upper and lower ends, the lower ends of said upper tubes being welded to the upper ends of the lower divergent tubes, wherein said upper tubes have rounded projections (7) disposed on their upper ends;

wherein a first pair of said frameworks are coplanar and fixed to one another at their adjacent upper tubes (6), and a second pair of said frameworks are coplanar and fixed to one another at their adjacent upper tubes (6), and said second pair of frameworks is situated on a plane parallel to the first pair of said frameworks, said first and second pairs of frameworks being connected by at least one bedplate (2) and at least one crossbeam (8) of a substantially shorter length than the length of said carriage (10).

4. A support (1 )for casks (9) including a structure allowing the mounting of a pair of casks on the same support, said support being adapted to be stacked on another one of said supports in a staggered manner, said support comprising two bedplates (2), each bedplate including a seating for the housing of a cask (9), said seating formed by a carriage (10) with freedom of movement parallel to the bedplate (2) and perpendicular to a vertical plane defined by a framework of the support (1), characterised in that a prismatic-quadrangular angle block (3) is fixed on a lower part of each one of opposed ends of each bedplate (2), said angle block (3) having a wide hole (20) disposed on an upper level thereof, said wide hole adapted to receive lifting arm therein, and a receptacle (21) disposed on a lower level of said angle block, said receptacle being open towards a lower side of said angle block and upwardly convergent.

* * * * *

UNITED STATES PATENT AND TRADEMARK OFFICE

CERTIFICATE OF CORRECTION

PATENT NO. : 7,044,311 B2
APPLICATION NO. : 10/819497
DATED : May 16, 2006
INVENTOR(S) : Sebastian Flores Flores It is certified that error appears in the above-identified patent and that said Letters Patent is hereby corrected as shown below:

Column 4, line 66, delete the first "(15)" and enter --(18)--.

Column 5, line 20, delete the first "the".

Column 5, line 21, delete "1" and enter --(1)--.

Column 6, line 30, after the word, "receive", enter --a--.

Signed and Sealed this

Eleventh Day of July, 2006

JON W. DUDAS
*Director of the United States Patent and Trademark Office*